US008284143B2

(12) United States Patent
Park et al.

(10) Patent No.: US 8,284,143 B2
(45) Date of Patent: Oct. 9, 2012

(54) TIMING CONTROLLER, LIQUID CRYSTAL DISPLAY DEVICE HAVING THE SAME, AND DRIVING METHOD THEREOF

(75) Inventors: Jae-Hyoung Park, Yongin-si (KR); Woo-Chul Kim, Uijeongbu-si (KR)

(73) Assignee: Samsung Electronics Co., Ltd. (KR)

( * ) Notice: Subject to any disclaimer, the term of this patent is extended or adjusted under 35 U.S.C. 154(b) by 1020 days.

(21) Appl. No.: 12/016,460

(22) Filed: Jan. 18, 2008

(65) Prior Publication Data

US 2008/0174591 A1 Jul. 24, 2008

(30) Foreign Application Priority Data

Jan. 19, 2007 (KR) ..... 10-2007-0006327

(51) Int. Cl.
*G09G 3/36* (2006.01)
*G09G 5/10* (2006.01)

(52) U.S. Cl. ..... 345/94; 345/690; 345/87; 345/89; 345/98; 345/99; 345/100

(58) Field of Classification Search ..... 345/204, 345/690, 87, 89, 94, 98–100
See application file for complete search history.

(56) References Cited

U.S. PATENT DOCUMENTS

| | | | | |
|---|---|---|---|---|
| 6,344,888 | B2 * | 2/2002 | Yasukawa | 349/113 |
| 7,728,803 | B2 * | 6/2010 | Hu | 345/89 |
| 7,804,474 | B2 * | 9/2010 | Chen et al. | 345/98 |
| 2002/0024481 | A1 * | 2/2002 | Kawabe et al. | 345/87 |
| 2006/0132470 | A1 * | 6/2006 | Ho et al. | 345/204 |

* cited by examiner

*Primary Examiner* — Bipin Shalwala
*Assistant Examiner* — Ilana Spar
(74) *Attorney, Agent, or Firm* — Innovation Counsel LLP

(57) ABSTRACT

A timing controller includes a frame memory capable of storing previous frame data, a comparator structured to output a selection control signal in response to comparison of the previous frame data supplied from the frame memory with current frame data, an overdriver unit structured to output a compensation data signal in response to comparison of the previous frame data and the current frame data, a saturation voltage data supplying unit structured to generate a saturation voltage data signal in response to comparison of the previous frame data and the current frame data, and an outputting unit capable of selectively outputting either the compensation data signal or the saturation voltage data signal in response to the selection control signal.

19 Claims, 7 Drawing Sheets

FIG. 7

| | | fn-1 | | | | | | | | | | | | | | | | |
|---|---|---|---|---|---|---|---|---|---|---|---|---|---|---|---|---|---|---|
| | | 0 | 64 | 128 | 192 | 256 | 320 | 384 | 448 | 512 | 576 | 640 | 704 | 768 | 832 | 896 | 960 | 1024 |
| fn | 0 | 0 | 0 | 0 | 0 | 0 | 0 | 0 | 0 | 0 | 0 | 0 | 0 | 0 | 0 | 0 | 0 | |
| | 64 | 0 | 0 | 0 | 0 | 0 | 0 | 0 | 0 | 0 | 0 | 0 | 0 | 0 | 0 | 0 | 0 | |
| | 128 | 0 | 0 | 0 | 0 | 0 | 0 | 0 | 0 | 0 | 0 | 0 | 0 | 0 | 0 | 0 | 0 | |
| | 192 | 0 | 0 | 0 | 0 | 0 | 0 | 0 | 0 | 0 | 0 | 0 | 0 | 0 | 0 | 0 | 0 | |
| | 256 | 0 | 0 | 0 | 0 | 0 | 0 | 0 | 0 | 0 | 0 | 0 | 0 | 0 | 0 | 0 | 0 | |
| | 384 | 0 | 0 | 0 | 0 | 0 | 0 | 0 | 0 | 0 | 0 | 0 | 0 | 0 | 0 | 0 | 0 | |
| | 448 | 0 | 0 | 0 | 0 | 0 | 0 | 0 | 0 | 0 | 0 | 0 | 0 | 0 | 0 | 0 | 0 | |
| | 512 | 0 | 0 | 0 | 0 | 0 | 0 | 0 | 0 | 0 | 0 | 0 | 0 | 0 | 0 | 0 | 0 | |
| | 576 | 0 | 0 | 0 | 0 | 0 | 0 | 0 | 0 | 0 | 0 | 0 | 0 | 0 | 0 | 0 | 0 | |
| | 640 | 0 | 0 | 0 | 0 | 0 | 0 | 0 | 0 | 0 | 0 | 0 | 0 | 0 | 0 | 0 | 0 | |
| | 704 | 832 | 864 | 896 | 928 | 960 | 0 | 0 | 0 | 0 | 0 | 0 | 0 | 0 | 0 | 0 | 0 | |
| | 768 | 832 | 864 | 896 | 928 | 960 | 0 | 0 | 0 | 0 | 0 | 0 | 0 | 0 | 0 | 0 | 0 | |
| | 832 | 832 | 864 | 896 | 928 | 960 | 0 | 0 | 0 | 0 | 0 | 0 | 0 | 0 | 0 | 0 | 0 | |
| | 896 | 832 | 864 | 896 | 928 | 960 | 0 | 0 | 0 | 0 | 0 | 0 | 0 | 0 | 0 | 0 | 0 | |
| | 960 | 832 | 864 | 896 | 928 | 960 | 0 | 0 | 0 | 0 | 0 | 0 | 0 | 0 | 0 | 0 | 0 | |
| | 1024 | | | | | | | | | | | | | | | | | |

LOOKUP TABLE

TIMING CONTROLLER, LIQUID CRYSTAL DISPLAY DEVICE HAVING THE SAME, AND DRIVING METHOD THEREOF

CROSS-REFERENCE TO RELATED APPLICATION

The present application claims priority from Korean Patent Application No. 2007-0006327 filed on Jan. 19, 2007, the disclosure of which is incorporated herein by reference in its entirety.

BACKGROUND

1. Field of Invention

The present disclosure of invention relates to a timing controller, a liquid crystal display ("LCD") device including the timing controller, and a driving method of the LCD device that employ an overdrive feature and in which effectiveness of overdrive is limited by a finite liquid crystal response speed.

2. Discussion of Related Technology

A liquid crystal display ("LCD") device typically includes an LCD panel for displaying an image, a backlighting assembly for supplying light to the LCD panel, and a panel driving unit for electronically driving the LCD panel.

The LCD panel typically comprises a thin film transistors (TFT's) containing substrate having an array of thin film transistors formed thereon, a color filters substrate having an array of color filters formed thereon, and liquid crystal material interposed between the thin film transistors substrate and the color filters substrate.

In the above-configured LCD panel, optical orientation of the liquid crystals is driven by an electric field generated between a pixel-electrode provided on the thin film transistors substrate and a common electrode provided on the color filter substrate. A capacitor formed by the pixel-electrode and common electrode is charged to a field-defining voltage by passing a supplied driving voltage from a panel driving unit through the TFT and to the pixel-electrode. Transmissivity of light supplied from a backlight assembly can be controlled this way in order to display an image.

The liquid crystal material generally has intrinsic properties of viscosity and elasticity which result in a finite and relatively slow response speed to fast changing electrical pulses and in hold time driving characteristic, whereby data of a previous frame can cause a problem of old image retention during the playing of a high speed moving picture. To solve this problem, a dynamic capacitance compensation ("DCC") method is often used for compensating for the slow response speed of liquid crystals by overdriving the liquid crystals so as to urge them to reach a target state faster, for example by applying a driving voltage pulse of higher magnitude than a target voltage to the pixel-electrode of the corresponding pixel in each image frame. FIG. 1A shows how an overdrive pulse having a magnitude denoted as overshoot is applied in frame number f(n) to a pixel in order for that pixel-electrode to thereby effectively charge the pixel-electrode to a desired Target Value by the time the time slot for driving that pixel-electrode expires. FIG. 1B shows a case where an overdriven pixel fails to reach its desired target value within the charging time of a single frame (f(n)) due to a saturation phenomenon and thus charging may have to continue in the next frame f(n+1) or beyond for the pixel-electrode to effectively charge to the desired target value.

More specifically, in one related art method of DCC driving of an LCD device, which method is represented by FIG. 1A, the magnitude of a previous frame data sample (in frame f(n−1)) is compared against the magnitude of the data sample for the current frame f(n) and the difference is determined. The amount of overshoot needed for changing state from the previous frame data state to that desired (Target) for the current frame is found for example in a look-up table (LUT) or calculated and then applied during a time slot of the current frame f(n) so as to thereby effectively reach the desired target value before the charging time slot for the current display row and frame f(n) expires. Hence, despite slow liquid crystal response speed, the pixel-electrode may often (but not always) reach the desired target value within the allotted time slot for charging that pixel-electrode (e.g., the display row charge time). While it remains the case that this overdriving method of DCC operation works when small values of overdrive are applied to the liquid crystals, there is a point of diminishing returns where the mechanism saturates as is shown in FIG. 1B and the crystals fail to respond fully to an excessive amount of applied overdrive voltage. If the overdrive voltage minus the previous pixel state exceeds a predetermined magnitude, i.e., a predetermined liquid crystal saturating step-voltage, the liquid crystals no longer respond linearly to the magnitude of the overdrive step and they therefore do not quickly reach the desired effective target value. The crystals' response instead saturates within the allotted charging time to a state corresponding to what can be called an effective liquid crystal saturation voltage.

Alternatively, it is possible to improve an apparent liquid crystal response speed by a method of stepwise partial overdriving across a plurality of frames (where f(n) of FIG. 1B might be the first partial overdrive) and then further overdriving the partially overdriven pixel in yet a next frame (f(n+1)) to thereby reach the target value in the span of two frames rather than just one. However, such a possible (but generally not practical) partial overdrive method suffers from the disadvantage that it calls for a large memory capable of storing at least two frames worth of image data, thus causing a problem that cost for the frame memories is substantially increased in case of an LCD device of high resolution. Moreover, if such a two frame partial overdrive method is used, there still occurs the problem in the case where the pixel of the previous frame is mostly black (or otherwise very dark) while the current frame is mostly white (or otherwise very bright) so that luminance in extreme changing spots of a previous frame f(n) and of a current frame f(n+1) are mutually exchanged with each other due to crosstalk on a boundary between maximum black data of a previous frame and brightest white data of a current frame and this effect is still seen as an unpleasant boundary flashing or inverting artifact by the person watching the LCD device.

SUMMARY

The present disclosure provides a timing controller, an LCD device including the timing controller, and a driving method of the LCD device, where image quality degradation due to luminance inversion at a boundary between maximum black data and minimum white data is prevented and the size of a frame memory is reduced.

In one embodiment, a timing controller is provided including: a frame memory capable of storing previous frame data, a comparator structured to output a first or second control signal in response to comparison of the previous frame data supplied from the frame memory with current frame data, an overdriver unit structured to output a compensation data signal whose value is computed/determined using the previous frame data and the current data, a saturation voltage data supplying unit structured to generate a saturation voltage data signal whose value is computed/determined using the previous frame data and the current frame data, and an outputting unit capable of selectively outputting either the compensation data signal or the saturation voltage data signal.

The saturation voltage supplying unit performs an operation on the previous frame data and the current frame data and then supplies a value of the operation as the saturation voltage data signal When the previous frame data is a value between 0 and predefined maximum black data and when the current frame data is a value between predefined minimum white data and maximum white value, the saturation voltage supplying unit produces the saturation voltage data signal whose magnitude is greater than the minimum white data.

In one embodiment, the saturation voltage data signal is caused to have a constant value even when the current frame data has a value varying between the predefined minimum white data and the maximum white data. However, the value of the saturation voltage data signal can vary according to the previous frame data.

When the current frame data is inputted as equal to or greater than the minimum white data and when the previous frame data is inputted as the value between 0 and the maximum black data, the saturation voltage data signal is varied according to the previous frame data.

The comparator further includes a memory storing values of the maximum black data and the minimum white data.

Saturation voltage data signals are stored in a lookup table (LUT) and mapped to range values equal to or smaller than the maximum black data of the previous frame data and values equal to or greater than the minimum white data of the current frame data.

The saturation voltage data supplying unit outputs one of the saturation voltage data signals stored in the lookup table supplied from the memory in a manner of matching the previous frame data and the current frame data.

In one embodiment, an LCD device is provided including an LCD panel having vertically alignable liquid crystals, a gate driver for driving gate lines of the LCD panel, a data driver for driving data lines of the LCD panel, a power supply structured to generate a power signal to the LCD panel, the gate driver, and the data driver, and a timing controller structured to supply a control signal to the gate driver and the data driver and to selectively generate one of a saturation voltage data signal corresponding to a saturation response speed of the liquid crystals and a compensation data signal in response to frame data signals inputted from an external source.

The timing controller includes a frame memory that is capable of storing the externally supplied previous frame data, a comparator for outputting a first or second control signal as determined by comparing the previous frame data supplied from the frame memory with current frame data, an overdriver unit for outputting the compensation data signal, a saturation voltage data supplying unit for supplying the saturation voltage data signal, and an outputting unit for selectively supplying the data driver with either the compensation data signal or the saturation voltage data signal.

In one embodiment, the saturation voltage supplying unit performs an operation on the previous frame data and the current frame data and then outputs a value of the operation as the saturation voltage data signal. The saturation voltage data supplying unit causes the saturation voltage data signal to be greater than the predefined minimum white data level when the previous frame data signal is of a value between 0 and maximum black data and when the current frame data is of a value between the predefined minimum white data level and the maximum white data level.

The LCD device further includes a memory for supplying the predefined maximum black data level and the minimum white data level to the comparator.

The memory further includes a lookup table in which saturation voltage data signals are mapped relative to values equal to or smaller than the maximum black data of the previous frame data and values equal to or greater than the minimum white data of the current frame data.

The saturation voltage data supplying unit outputs one of the saturation voltage data signals stored in the lookup table in a manner of mapping the previous frame data and the current frame data.

In a further aspect, a method of driving an LCD device includes generating a saturation voltage data signal by performing an operation on previous frame data and current frame data, generating a compensation data signal by performing an operation of the previous frame data and the current frame data, generating a selection control signal by comparing the previous frame data and the current frame data, and selectively outputting either the saturation voltage data signal or the compensation data signal according to the selection control signals.

The step of generating the saturation voltage data includes inputting a preset maximum black data level and a preset minimum white data level, automatically determining when the previous frame data is one of values equal to or smaller than the inputted maximum black data level and when the current frame data is one of values equal to or greater than the inputted minimum white data level, and in response to said determining, generating the saturation voltage data signal as one having a value equal to or greater than the preset minimum white data.

The step of generating saturation voltage may include using a lookup table that stores saturation voltage data values mapped to values equal to or smaller than the maximum black data of the previous frame data and values equal to or greater than the minimum white data of the current frame data.

The step of generating saturation voltage may include reading one of the LUT-contained saturation voltage data values resulting from matching the previous frame data, the current frame data and the saturation voltage data signal stored in the lookup table.

It is to be understood that both the foregoing general description and the following detailed description are merely exemplary and explanatory and not intended to be unduly limiting.

BRIEF DESCRIPTION OF THE DRAWINGS

The accompanying drawings are included to provide a further understanding of the disclosed embodiments and serve to better explain the principles of the disclosure. In the drawings:

FIG. 7 is a table diagram of a lookup table for saturation voltage data stored in the timing controller shown in FIG. 6 according to the second embodiment of the present invention.

DETAILED DESCRIPTION

Reference will now be made in detail to the exemplary embodiments of the present disclosure, examples of which are illustrated in the accompanying drawings. Wherever possible, the same reference numbers will be used throughout the drawings to refer to the same or like parts.

Figure 1A:
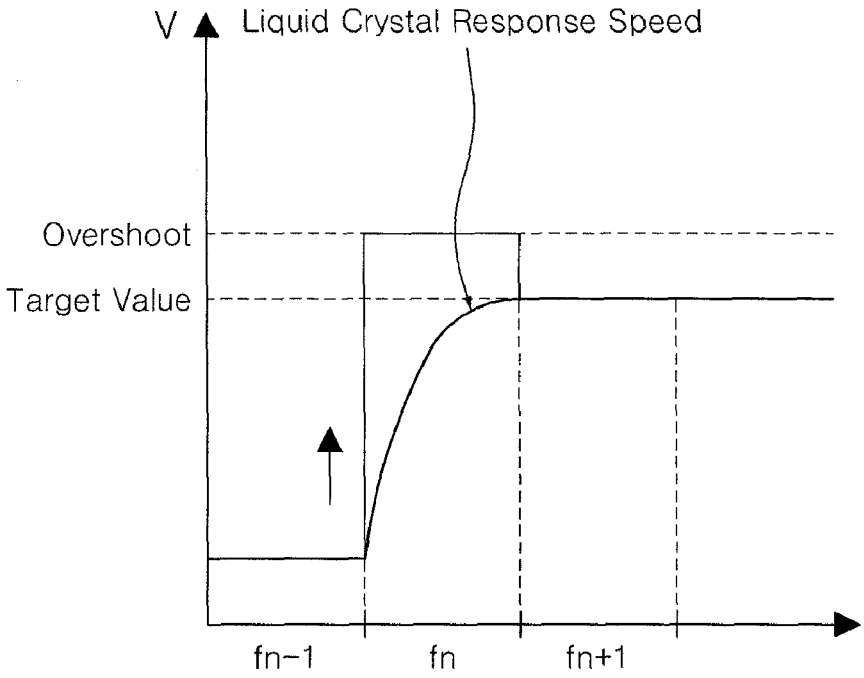
FIG. 1A (PRIOR ART)
FIG. 1A and FIG. 1B are timing diagrams for liquid crystal responses of an LCD device according to related DCC driving technology.
Figure 1B:
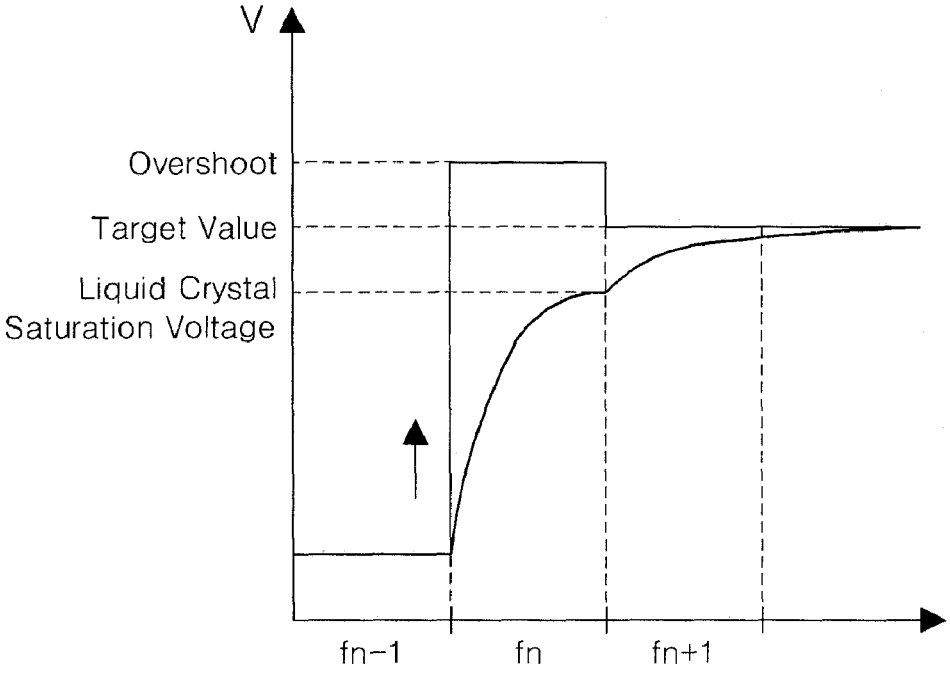
FIG. 1B (PRIOR ART)
Figure 2:
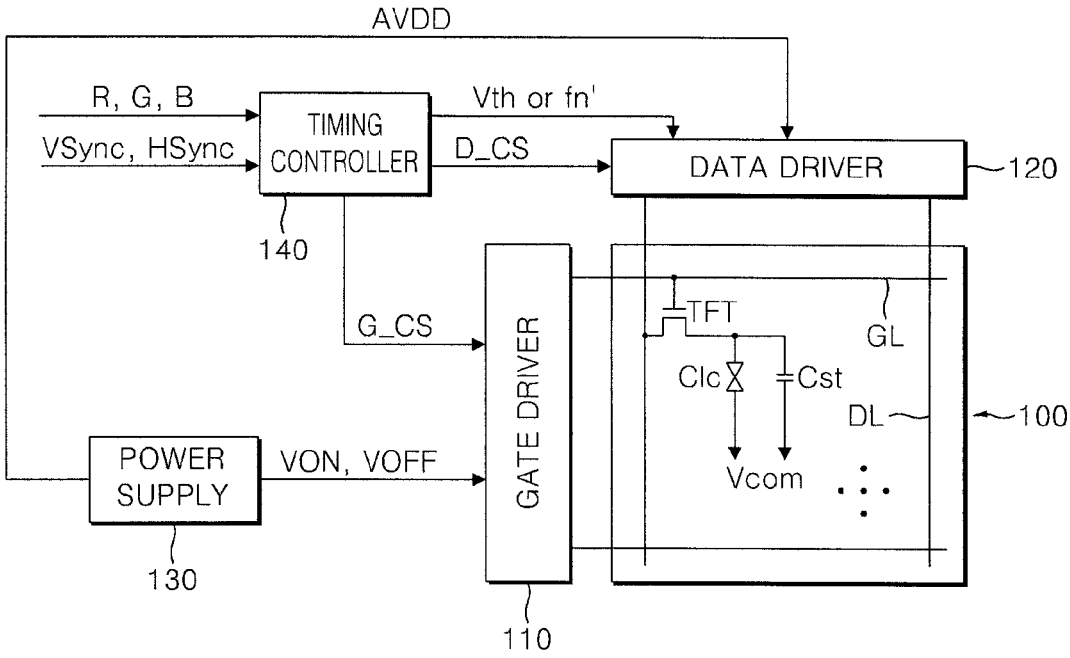
FIG. 2 is a schematic block diagram of an LCD device according to one embodiment of the present invention.
Figure 3A:
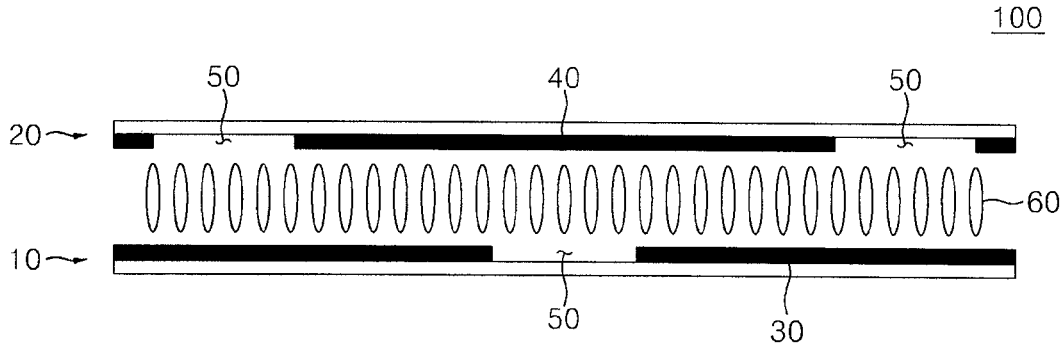
FIGS. 3A to 3C are cross-sectional diagrams for a process for driving liquid crystals after applying a voltage to an LCD panel of the LCD device shown in FIG. 2.
Figure 3B:
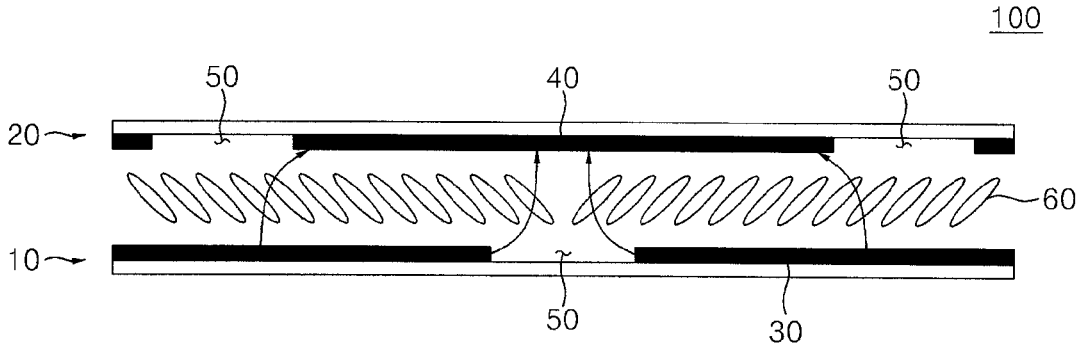
Figure 3C:
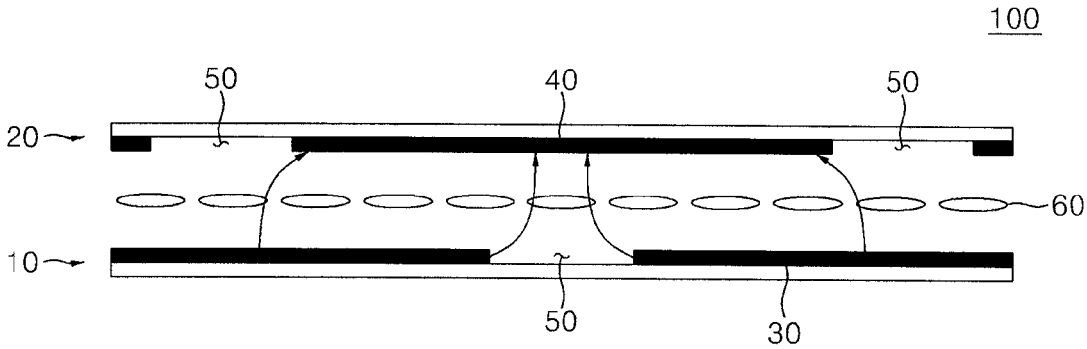

FIG. 2 is a schematic block diagram of an LCD device according to one embodiment and FIGS. 3A to 3C are cross-sectional diagrams for a process for driving liquid crystals after applying a voltage to an LCD panel of the LCD device shown in FIG. 2.

Figure 4:
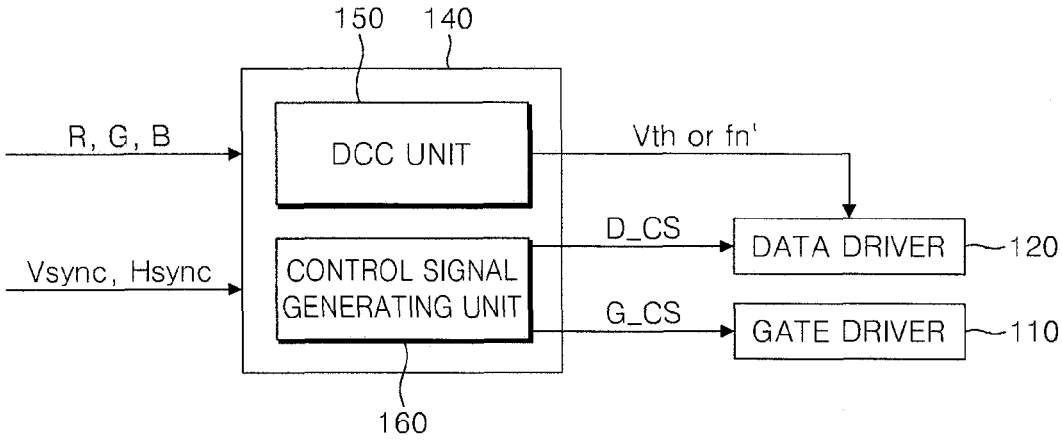
FIG. 4 is a schematic block diagram of a timing controller shown in FIG. 2.

Referring to FIG. 2 and FIGS. 3A to 3C, an LCD device according to one embodiment includes an LCD panel 100, a gate driver 110, a data driver 120, a timing controller 140, and a power supply 130. As shown in FIG. 4, the timing controller 140 includes a control signal generating unit 160 and a dynamic capacitance compensation (DCC) unit 150, as will be described in more detail below.

The LCD panel 100 includes a first substrate 10, a second substrates 20 configured to oppose the first substrate 10, and liquid crystals inserted between the first and second substrates 10 and 20.

The first substrate 10 includes a plurality of gate lines GL, a plurality of data lines DL configured to cross with the gate lines GL, and a plurality of thin film transistors (TFT's) provided at respective intersections between the gate and data lines GL and DL, and a plurality of pixel electrodes 30 respectively connected to and driven by the respective thin film transistors (TFT's).

FIG. 2 shows an example of one pixel unit where the respective thin film transistor (TFT) includes a gate electrode connected to the adjacent gate line GL, a gate insulating layer on the gate electrode, a semiconductor layer on the gate insulating layer to be overlapped with the gate electrode, a source electrode on the semiconductor layer to be overlapped with the gate electrode and connected to the adjacent data line DL, and a drain electrode configured to oppose the source electrode to be connected to the adjacent pixel electrode via a pixel contact hole (drain contact). The pixel-electrode in combination with an opposed common electrode forms a liquid crystal capacitor (Clc). The thin film transistor TFT is turned on by applying a gate-on voltage (VON) via the corresponding gate line GL and the TFT then passes a supplied data voltage to the corresponding pixel electrode (a plate of the liquid crystal capacitor Clc) with the data voltage being supplied via the data line DL. The pixel electrode can construct a storage capacitor Cst by being overlapped with a storage line. The storage capacitor Cst sustains the data voltage, which is supplied to the pixel electrode, for one frame by a voltage supplied to the storage line.

The second substrate 20 includes a black matrix configured to oppose the gate line GL, the data line DL and the thin film transistor TFT, a color filter configured to oppose the pixel electrode 30, and a transparent common electrode 40 configured to cover the color filter.

A process for driving liquid crystals according to one embodiment of the present invention is explained with reference to FIGS. 3A to 3C as follows.

Referring to FIG. 3A, the liquid crystals 60 are vertically aligned between the two substrates 10 and 20. In the LCD panel 100, slits 50 are patterned in a manner of being alternately overlapped with the pixel electrode 30 on the first substrate 10 or the common electrode 40 on the second substrate 20. If a data voltage is applied to the pixel electrode 30, a fringe field is generated between the two electrodes 30 and 40. The liquid crystals 60, as shown in FIG. 3B and FIG. 3C, are sequentially driven to orient themselves inwardly by the fringe field from an area where the slit 50 is formed.

The power supply 130 generates such power signals as gate-on and gate-off voltages VON and VOFF, an analog driving voltage AVDD, and a common voltage Vcom from an external driving voltage.

The gate-on and gate-off voltages VON and VOFF are supplied to the gate driver 110. The analog driving voltage AVDD is supplied to a gamma voltage generator (not shown) included in the data driver 120. The common voltage Vcom is supplied to the common electrode 40 of the LCD panel 100.

The gate driver 110 sequentially supplies the gate-on voltage VON to the gate lines GL according to the gate-on and gate-off voltages VON and VOFF supplied by the power supply 130 and a gate control signal G_CS supplied by the timing controller 140. After the gate-on voltage VON has been supplied to a given gate line (LCD row) during a data charging time slot, the gate-off voltage VOFF is supplied for the rest time. So, the thin film transistor TFT connected to the gate line GL is sequentially driven per the gate line GL.

The data driver 120 of FIG. 2 receives one or another of a saturation voltage data signal Vth and a compensation data signal fn' inputted from the timing controller 140 and then supplies a corresponding analog-converted data voltage to the data line DL each time the gate-on voltage is supplied to the gate line GL, using a data control signal D_CS inputted by the timing controller 140. The data driver 120 may include a shift register, a latch, a digital-to-analog converter, an output buffer, and a gamma voltage supplier (not specifically shown).

In one embodiment, the shift register generates a sampling signal by sequentially shifting a data start pulse from the timing controller 140 according to a data shift clock. The latch sequentially latches a selected one of either a compensation data signal fn' or a saturation voltage data signal Vth inputted from the timing controller 140 in response to the sampling signal. When data amounting to a single horizontal line is latched, the latch outputs the latched data to the digital-to-analog converter. The digital-to-analog converter selects a gamma voltage corresponding to data from the latch from gamma voltages supplied by the gamma voltage supplier and then outputs the selected voltage as an analog data voltage. The output buffer buffers the data signal from the digital-to-analog converter and then supplies the buffered signal to the data lines DL.

In one embodiment, the timing controller 140 generates a gate control signal G_CS and a data control signal D_CS. The timing controller 140 transforms pixel data signals such as those representing the R, G and B colors as provided from outside and then supplies the transformed signals to the data driver 120. One embodiment of the timing controller 140 is now explained in greater detail with reference to FIGS. 4 to 8 as follows.

Figure 5:
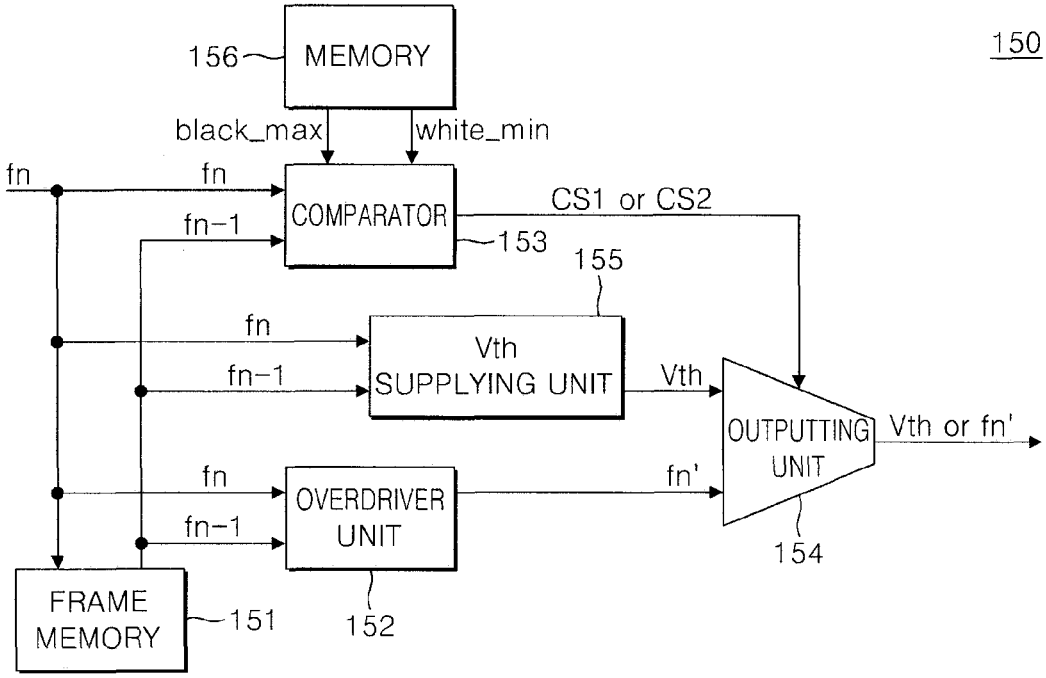
FIG. 5 is a block diagram of the timing controller shown in FIG. 4 according to a first embodiment of the present invention.

FIG. 4 is a schematic block diagram of a timing controller according to a first embodiment of the present disclosure, and FIG. 5 is a schematic diagram of a dynamic capacitance compensation (DCC) unit shown in FIG. 4.

Referring to FIG. 4 and FIG. 5, the timing controller 140 includes a DCC unit 150 and a control signal generating unit 160.

The control signal generating unit 160 generates a gate control signal G_CS and a data control signal D_CS to be respectively supplied to the gate driver 110 and the data driver 120 by the control signal generating unit 160 using a vertical sync signal Vsync and a horizontal sync signal Hsync inputted from outside.

In one embodiment, the gate control signal G_CS includes a gate start pulse, a gate shift clock, a gate output control signal, and the like. The data control signal D_CS includes a data start pulse, a data shift clock, a data output control signal, a polarity control signal, and the like.

The DCC unit 150 (see FIG. 5) compares a previous frame data signal, fn−1 and current frame data signal, fn to each other and then responsively outputs a selected one of first compensation data signal fn' and saturation voltage data signal Vth.

The DCC unit 150, as shown in FIG. 5, includes a frame memory 151, a comparator 153, an overdriver unit 152, a saturation voltage data supplying unit 155, and an outputting unit 154 (e.g., a digital multiplexer 154).

The frame memory 151 stores each previous frame data signal fn−1 of each displayed pixel of the LCD device 100. While a current frame data signal fn of a first pixel is inputted, the frame memory 151 outputs the stored previous frame data signal fn−1 of the same pixel to the comparator 153. The frame memory 151 stores new frame data for each frame.

The comparator 153 compares the current frame data signal fn and the previous frame data signal fn−1 inputted from the frame memory 151 and then outputs either a first control signal CS1 or a second control signal CS2. When comparison values of the current and previous frame data signals fn and fn−1 are equal to or greater than a preset value, the comparator 153 outputs the first control signal CS1. When comparison values of the current and previous frame data signals fn and fn−1 are smaller than the preset value, the comparator 153 outputs the second control signal CS2. For instance, in one embodiment, if the previous frame data signal fn−1 is one representing black data for example in a value range from 0 to 256 (out of the larger range 0-1023, in other words, the lower roughly 25%) and at the same time if the current frame data signal, fn is one representing white data for example in a value range from 704 to 1023 (in other words, the upper roughly 32% of a larger range having 1024 discrete value points so that the difference between fn and fn−1 is at least 704−256=448), then, the comparator 153 outputs the first control signal CS1 corresponding to selection by multiplexer 154 of the Vth signal. For the rest of the cases (where the difference between fn and fn−1 is less than 448), the comparator 153 outputs the second control signal CS2. In the latter case, the second control signal CS2 is the control signal for causing the multiplexer 154 to output the compensation data signal fn' generated by overdriver unit 152.

The above values of 704 and 256 are merely examples. More generally, a maximum black data value signal, black_max (for the fn−1 sample) and a minimum white data value signal, white_min (for the fn sample) are preset in a programmable memory 156 and are inputted to the comparator 153. If the previous frame data signal fn−1 is a value equal to or smaller than the maximum black data value signal, black_max and if the current frame data signal fn is a value equal to or greater than the minimum white data value signal white_min, the comparator 153 outputs the first control signal CS1. For the rest of the cases, the comparator 153 outputs the second control signal CS2. In the example given above, the maximum black data signal, black_max represents a maximum data value indicating a black gray scale. Namely, if a maximum gray scale value of the LCD device is 1,023, the maximum black data black_max can be set to 256. The minimum white data white_min in the given example represents a minimum data value indicating a relatively light gray scale. Namely, if a gray scale range of the LCD device is 0-1,023, the minimum white data white_min can be preset as 704.

Each of the first and second control signals CS1 and CS2 can be set to either 1 or 0, and vice versa. If '1' is outputted as the first control signal CS1, '0' is outputted as the second control signal CS2. On the contrary, if '0' is outputted as the first control signal CS1, '1' is outputted as the second control signal CS2.

The overdriver unit 152 generates compensation data signal fn' by comparing the previous frame data sample, fn−1 with the current frame data sample, fn for the same pixel. For instance, if the previous frame data sample, fn−1 is substantially smaller than the current frame data sample fn, the compensation data signal fn' may be caused to have an overdriven data value that is greater than the supplied current frame data signal, fn. Contrastingly, if the previous frame data signal, fn−1 is substantially greater than the current frame data signal fn, then the compensation data signal fn' may be caused to have an underdriven data value that is smaller than the current frame data signal fn. In other words, the compensation data signal fn' is often outputted as a frame data value having a gray scale different than the current frame data signal fn by adding or subtracting a looked-up or calculated difference value corresponding to a difference between the two frame data signals, fn−1 and fn.

In one embodiment, when the previous frame data signal fn−1 is greater than the current frame data signal fn, the overdriver unit 152 outputs a calculated compensation data signal fn' having a frame data value obtained from subtracting a calculated difference value between the two frames fn−1 and fn from the current frame data signal fn or by subtracting a value defined by the difference value between the two frame data signals fn−1 and fn from the current frame data signal fn.

The saturation voltage data supplying unit 155 receives the previous frame data signal fn−1 and the current frame data signal fn and then generates a corresponding saturation voltage data signal, Vth. In one embodiment, the saturation voltage data signal Vth is defined as a value greater than the value equal to or greater than that of the minimum white data signal, white_min and is selected by considering the response speed of the liquid crystals in the LCD device when the previous frame data signal fn−1 is one of the values equal to or smaller than the maximum black data black_max and when the current frame data signal fn is one of the values equal to or greater than the minimum white data white_min. Namely, the saturation voltage data supplying unit 155 generates the saturation voltage data signal Vth according to the current frame data signal fn and the previous frame data signal fn−1. So, the saturation voltage data supplying unit 155 enables the generated saturation voltage data signal Vth to vary for each pixel and for each frame. For instance, in case that frame data of a given pixel is supplied by 10 bits, the saturation voltage data supplying unit 155 performs calculation in a manner that the response speed of the liquid crystals 60 has a value greater than the current frame data signal fn at a boundary of the maximum black data black_max, i.e., 256, when the previous frame data signal fn−1 is one of 0 to 256 and when the current frame data signal fn is one of 704 to 1,023.

The outputting unit 154 outputs either the compensation data signal fn' or the saturation voltage data signal Vth, using the controls signals CS1 and CS2, the compensation data signal fn' and the saturation voltage data signal Vth inputted from the comparator 153, the overdriver unit 152 and the saturation voltage data supplying unit 155, respectively. For instance, if the first control signal CS1 is inputted from the comparator 153, the outputting unit 154 (multiplexer 154) outputs the saturation voltage data signal Vth inputted from the saturation voltage data supplying unit 155. In particular, when the previous frame data signal fn−1 is equal to or smaller than the maximum black data black_max and when the current frame data signal fn is equal to or greater than the minimum white data white_min, the outputting unit 154 outputs the saturation voltage data signal Vth.

If the second control signal CS2 is inputted from the comparator 153, the outputting unit 154 outputs the compensation data signal fn'. In particular, the outputting unit 154 outputs the compensation data signal fn' when the previous frame data signal fn−1 is equal to or greater than the maximum black data black_max or when the current frame data signal fn is equal to or smaller than the minimum white data white_min. So, the outputting unit 154 outputs the saturation voltage data signal Vth limited to a saturation response speed of the liquid crystals 60 to prevent the supply of excessive overdrive data that exceeds the saturation response speed of the liquid crystals 60. As a result, the excessive overdrive artifact that may be otherwise strongly seen is subdued by substituting the saturation voltage data signal Vth in place of the compensation data signal fn' in appropriate cases.

Figure 6:
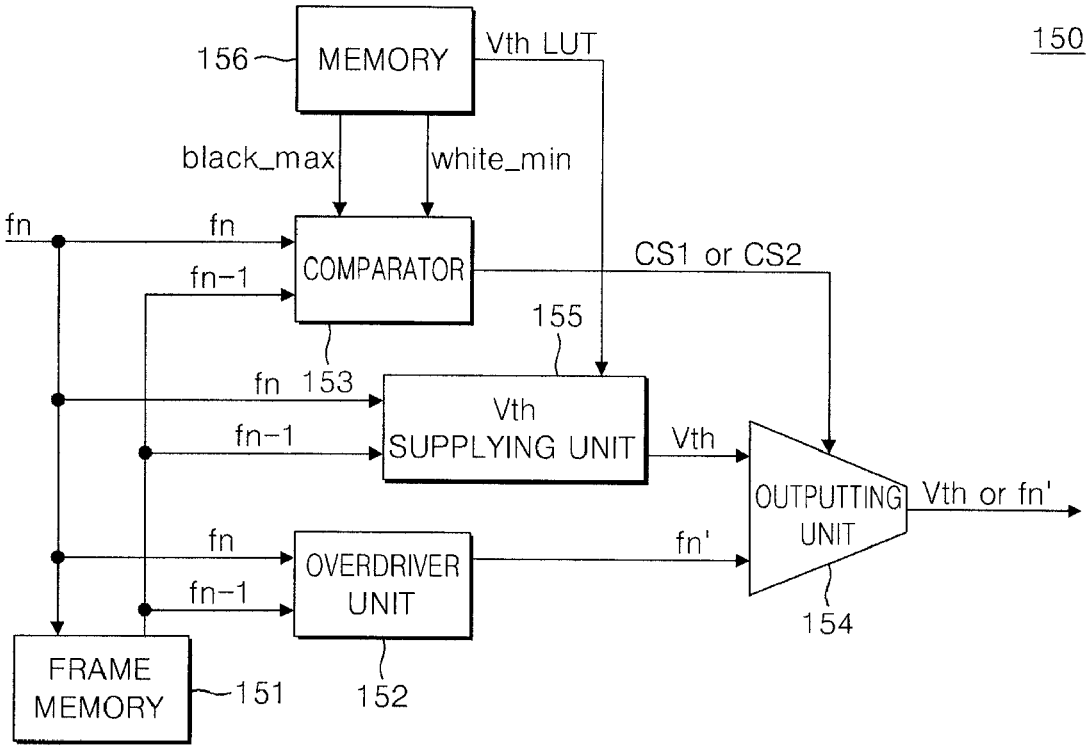
FIG. 6 is a block diagram of a timing controller according to a second embodiment of the present invention.

FIG. 6 is a block diagram of a timing controller 150 according to a second embodiment. Comparing FIG. 6 to FIG. 5, the difference lies in the structuring of units 155 and 156. In the embodiment of FIG. 6, the timing controller 150 includes a memory 156 that not only supplies the maximum black data signal, black_max and the minimum white data signal, white_min to the comparator 153, but the memory 156 stores a LUT-selecting signal (Vth LUT) that will select one of plural LUTs in unit 156 for generating the saturation voltage data signal Vth as a function of the selected lookup table ("LUT"). A saturation voltage data supplying unit 155 selects to output the saturation voltage data signal Vth stored in the selected LUT according to the previous frame data signal fn−1 and current frame data signal fn.

More specifically, the memory 156 supplies preset maximum black data black_max and preset minimum white data white_min to the comparator 153. The memory 156 may include a copy of or select the to-be-utilized LUT in which the saturation voltage data signal Vth matched to each of the previous and current frame data signals fn−1 and fn is stored, such as the one shown in FIG. 7. If the previous frame data signal fn−1 is black data and if the current frame data signal fn is white data, the utilized LUT (as implemented in unit 155) stores the saturation voltage data signal Vth determined on the boundary in-between. For instance, if the previous frame data signal fn−1 is 0 and if the current frame data signal fn is equal to or greater than 704, '832' is stored as the saturation voltage data signal Vth. So, if a white gray scale value of the current frame data signal fn exceeds '704', the same saturation voltage data signal Vth is stored. If the previous frame data signal fn−1 is '256' and if the current frame data signal fn is equal to or greater than '704', '960' is stored as the to-be-used saturation voltage data signal Vth. In this case, if the previous frame data signal fn−1 is greater than '256', '0' is stored as the saturation voltage data signal Vth according to the current frame data signal fn.

A size of the utilized LUT can be kept relatively small by storing data only for ranges bounded by the maximum black data level, black_max and the minimum white data level, white_min. In other words, saturation voltage data signal Vth including the previous frame data signal fn−1 having a value of 0 to 256 and current frame data signal fn having a value equal to or greater than 704 is stored and the rest of the values are automatically outputted as 0 without actually being stored as such. Thus, a storage capacity of the Vth providing LUT (see FIG. 7) is decreased to reduce the size of memory utilized by the system.

The saturation voltage data supplying unit 155 outputs the saturation voltage data signal Vth in a manner of matching the previous frame data signal fn−1 and the current frame data signal fn in the utilized Vth LUT that is inputted from or selected by the memory 156. For instance, if the previous frame data signal fn−1 is 0 and if the current frame data signal fn is equal to or greater than 704, the saturation voltage data supplying unit 155 outputs the saturation voltage data signal Vth of '832'. If the previous frame data signal fn−1 is 256 and if the current frame data signal fn is equal to or greater than 704, the saturation voltage data supplying unit 155 outputs the saturation voltage data signal Vth of '960'. If the previous frame data of 0 to 256 and the current frame data signal fn of 704 to 960 are inputted, the saturation voltage data supplying unit 155 selects to output one of the saturation voltage data signal Vth between 832 and 960.

The outputting unit 154 selectively outputs either the compensation data signal, fn' inputted from the overdriver unit 152 or the saturation voltage data signal, Vth inputted from the saturation voltage data supplying unit 155. For instance, the outputting unit 154 outputs the saturation voltage data signal Vth if the first control signal CS1 is inputted. The outputting unit 154 outputs the compensation data signal fn' if the second control signal CS2 is inputted.

In one embodiment, the timing controller 140 is implemented within a monolithic integrated circuit. The frame memory 151 and the levels memory 156 may be formed within or outside the IC of the timing controller 140.

Figure 8:
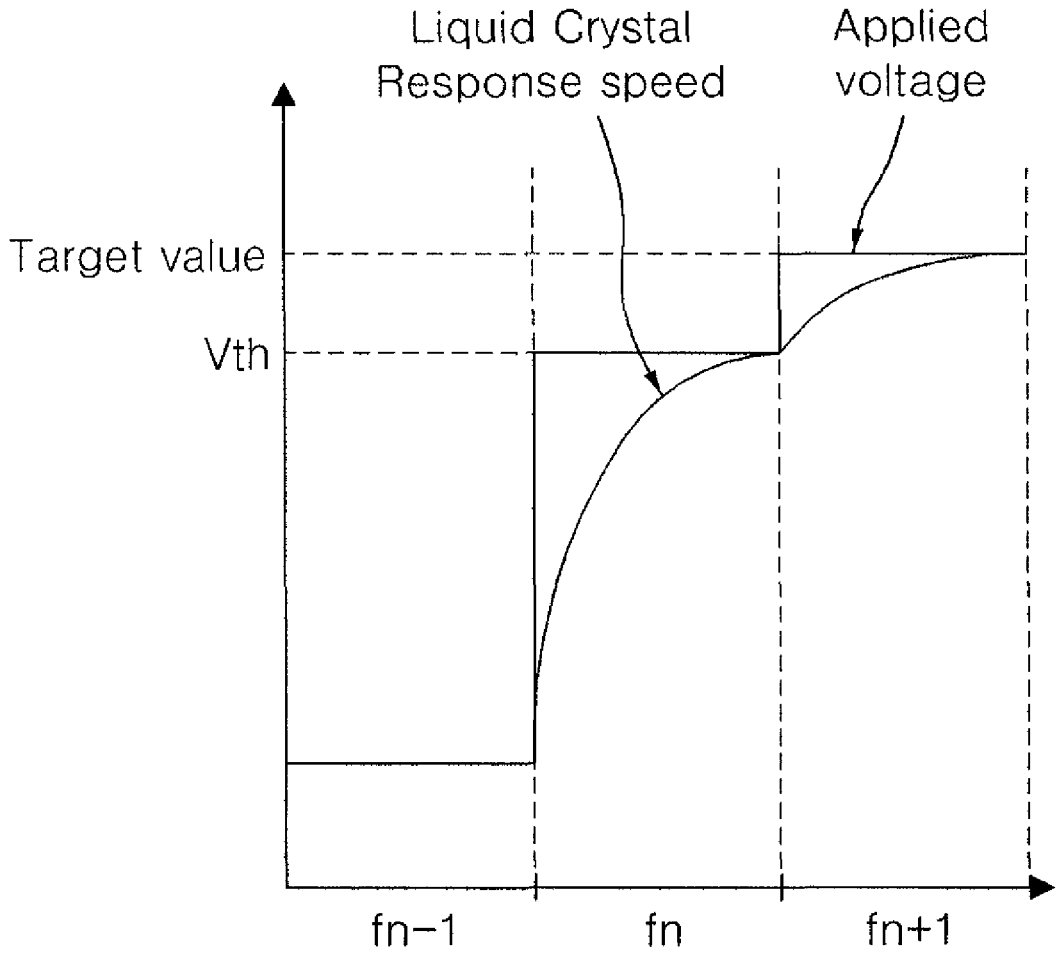
FIG. 8 is a timing diagram of liquid crystal response of an LCD device according to one embodiment of the present invention.

Referring to FIG. 8, when the saturation voltage data signal Vth is supplied to a pixel of the above-configured LCD device, the liquid crystals of the pixel respond according to the liquid crystal response speed curve shown in FIG. 8. Instead of directly supplying the current frame data signal, fn as a target value, the saturation voltage data signal, Vth is instead supplied during frame f(n) to transition the liquid crystals to about as far as they can go given the allotted drive time and the response speed of the crystals. Then, when in a next frame, the data signal fn+1 is supplied, the liquid crystals are driven to the target value of the signal fn+1. In the above-configured LCD device, if the previous frame data signal fn−1 is equal to or smaller than the maximum black data level, black_max and if the current frame data signal fn is equal to or greater than the minimum white data level, white_min, then the saturation voltage data value, Vth corresponding to the saturation response speed of the liquid crystals is instead supplied as the drive signal. In one embodiment, the saturation voltage data signal Vth is supplied in a manner of being varied for each frame at the boundary of the maximum black data black_max or the minimum white data white_min of the previous frame data signal fn−1.

Accordingly, systems in accordance with the present disclosure generate saturation voltage data signals corresponding to a saturation response speed of liquid crystals based on the previous frame data and the current frame data. Systems in accordance with the present disclosure also generate compensation data signals based on the previous frame data and the current frame data. If a gray scale difference between a previous frame and a current frame is not excessively big, an LCD device is driven by the compensation data. If the gray scale difference is excessively big, the LCD device is instead driven by the saturation voltage data. Hence, a system in accordance with the present disclosure prevents overdriving of pixels in cases where the pixel is asked to transition in one frame from a level at or below the maximum black data level to a level at or above the minimum white data level.

It will be apparent to those skilled in the art in light of the above that various modifications and variations can be made without departing from the spirit or scope of the disclosure. Thus, it is intended that the present disclosure covers the apparent modifications and variations that come within the scope of the disclosed embodiments and their equivalents.

What is claimed is:

1. A timing controller, comprising:

a frame memory capable of storing previous frame data;

a comparator structured to output a first control signal or a second control signal at least based on predetermined minimum white data and current frame data;

an overdriver unit structured to output a compensation data signal in response to a comparison of the previous frame data and the current frame data;

a saturation voltage data supplying unit structured to generate a saturation voltage data signal in response to the previous frame data and the current frame data, the saturation voltage data signal being limited according to at least one of allotted drive time and a response speed of liquid crystals in a liquid crystal display panel associated with the timing controller; and an outputting unit capable of selectively outputting either the compensation data signal or the saturation voltage data signal in response to a selection control signal, wherein the selection control signal is either the first control signal or the second control signal.

2. The timing controller of claim 1, wherein the saturation voltage supplying unit performs an operation on the previous frame data and the current frame data and then supplies a value of the operation as the saturation voltage data signal.

3. The timing controller of claim 1, wherein if the previous frame data is a value between 0 and predetermined maximum black data and if the current frame data is a value between the predetermined minimum white data and predetermined maximum white data, the saturation voltage data signal is greater than the predetermined minimum white data.

4. The timing controller of claim 1, wherein the saturation voltage data signal is a constant value if the current frame data is a value between the predetermined minimum white data and predetermined maximum white data.

5. The timing controller of claim 1, wherein if the current frame data is equal to or greater than the predetermined minimum white data and if the previous frame data is between 0 and predetermined maximum black data, the saturation voltage data signal is variable according to the previous frame data.

6. The timing controller of claim 1, wherein the comparator further comprises a memory storing values of predetermined maximum black data and the predetermined minimum white data.

7. The timing controller of claim 1, further comprising a memory storing a lookup table that maps saturation voltage data signals to values of the previous frame data equal to or smaller than predetermined maximum black data and values of the current frame data equal to or greater than the predetermined minimum white data.

8. The timing controller of claim 7, wherein the saturation voltage data supplying unit outputs one of the saturation voltage data signals stored in the lookup table supplied from the memory in a manner of matching the previous frame data and the current frame data.

9. The timing controller of claim 1, wherein the first control signal is associated with either the saturation voltage data signal or the compensation data signal, and the second control signal is associated with the other one.

10. A liquid crystal display device, comprising:

a liquid crystal display panel having vertically alignable liquid crystals;

a gate driver for driving gate lines of the liquid crystal display panel; a data driver for driving data lines of the liquid crystal display panel;

a power supply structured to supply a power signal to the liquid crystal display panel, the gate driver, and the data driver;

a frame memory capable of storing previous frame data; and a timing controller structured to:

output a first control signal or a second control signal at least based on a predetermined minimum white data and current frame data;

output a compensation data signal in response to a comparison of the previous frame data and the current frame data;

generate a saturation voltage data signal in response to the previous frame data and the current frame data, the saturation voltage data signal being limited according to at least one of allotted drive time and a response speed of liquid crystals in a liquid crystal display panel associated with the timing controller; and selectively output either the compensation data signal or the saturation voltage data signal in response to a selection control signal being as said first control signal or said second control signal.

11. The liquid crystal display device of claim 10, wherein the saturation voltage supplying unit performs an operation on the previous frame data and the current frame data and then outputs a value of the operation as the saturation voltage data signal.

12. The liquid crystal display device of claim 10, wherein the saturation voltage data supplying unit supplies the saturation voltage data signal having a value greater than the predetermined minimum white data if the previous frame data is a value between 0 and predetermined maximum black data and if the current frame data is a value between the predetermined minimum white data and predetermined maximum white data.

13. The liquid crystal display device of claim 10, further comprising a memory for supplying predetermined maximum black data and the predetermined minimum white data to the comparator.

14. The liquid crystal display device of claim 13, wherein the memory further comprises a lookup table that maps saturation voltage data signals to values of the previous frame data equal to or smaller than the predetermined maximum black data and values of the current frame data equal to or greater than the predetermined minimum white data.

15. The liquid crystal display device of claim 14, wherein the saturation voltage data supplying unit outputs one of the saturation voltage data signals stored in the lookup table supplied from the memory in a manner of mapping the previous frame data and the current frame data.

16. A method of driving a liquid crystal display device, comprising:

inputting predetermined minimum white data;

generating a saturation voltage data signal at least based on previous frame data and current frame data;

limiting the saturation voltage data signal according to at least one of allotted drive time and a response speed of liquid crystals in the liquid crystal display device;

generating a compensation data signal by performing an operation of the previous frame data and the current frame data;

generating a selection control signal by at least comparing the predetermined minimum white data and the current frame data; and selectively outputting either the saturation voltage data signal or the compensation data signal according to the selection control signal.

17. The method of claim 16, further comprising inputting predetermined maximum black data, wherein the step of generating a saturation voltage data signal comprises:

if the previous frame data is equal to or smaller than the predetermined maximum black data and if the current frame data is equal to or greater than the predetermined minimum white data, generating the saturation voltage data signal having a value equal to or greater than the predetermined minimum white data.

18. The method of claim 17, further comprising storing saturation voltage data signal values mapped to values of the previous frame data equal to or smaller than the predetermined maximum black data and values of the current frame data equal to or greater than the predetermined minimum white data in a lookup table.

19. The method of claim 18, wherein the step of generating a saturation voltage data signal comprises selecting one of the saturation voltage data signal values that matches the previous frame data and the current frame data from the lookup table.

* * * * *